US009539783B2

(12) United States Patent
Wischusen, III

(10) Patent No.: US 9,539,783 B2
(45) Date of Patent: Jan. 10, 2017

(54) REPLACEABLE CONTAINER LINER, SYSTEMS AND METHODS

(76) Inventor: Henry Wischusen, III, Duluth, GA (US)

( * ) Notice: Subject to any disclaimer, the term of this patent is extended or adjusted under 35 U.S.C. 154(b) by 676 days.

(21) Appl. No.: 13/339,365

(22) Filed: Dec. 28, 2011

(65) Prior Publication Data

US 2012/0165170 A1 Jun. 28, 2012

Related U.S. Application Data

(60) Provisional application No. 61/427,476, filed on Dec. 28, 2010.

(51) Int. Cl.
*B31B 7/00* (2006.01)
*B31B 1/00* (2006.01)

(52) U.S. Cl.
CPC ..... *B31B 1/00* (2013.01); *B31B 2217/0061* (2013.01); *B31B 2217/062* (2013.01)

(58) Field of Classification Search
CPC ... B65D 3/22; B65D 81/3874; B65D 81/3865; B65D 5/56; B65D 25/16; B65D 25/14; B65D 2543/00537; B31C 3/00; B31B 2217/0046; B31B 2217/0061; B31B 2217/062; B31B 2217/064; B31B 2217/0069
USPC ..... 493/100, 294, 907, 217; 53/175; 220/495.11, 23.87; 229/403
See application file for complete search history.

(56) References Cited

U.S. PATENT DOCUMENTS 1,035,718 A * 8/1912 Marsters ..... 220/738
3,373,917 A 3/1968 Cox
3,790,021 A * 2/1974 Bailey ..... B65D 25/14 220/495.03
4,036,675 A 7/1977 Amberg et al.
4,391,366 A 7/1983 Hirata
4,829,741 A * 5/1989 Langen ..... B65B 51/146 220/495.11
4,854,474 A 8/1989 Murray et al.
5,100,370 A * 3/1992 Barbour ..... B29C 63/34 493/100
5,279,537 A * 1/1994 Lile ..... 493/100
6,458,067 B1 10/2002 Dorin et al.
6,767,316 B2 * 7/2004 McQuary ..... B31B 7/00 493/100
6,889,455 B2 5/2005 Giraud
6,920,840 B1 * 7/2005 Sloan et al. ..... 119/14.47
7,513,386 B2 4/2009 Hartjes et al.
2005/0029337 A1 * 2/2005 Van Handel ..... 229/403
(Continued)

FOREIGN PATENT DOCUMENTS

WO WO9949770 A1 10/1999

*Primary Examiner* — Robert Long
*Assistant Examiner* — Xavier A Madison
(74) *Attorney, Agent, or Firm* — Crose Law LLC; Bradley D. Crose

(57) ABSTRACT

A removable conformal liner for a beverage container is described. When the liner is inserted into an internal cavity of a beverage container, the body of the liner substantially conforms to the interior cavity. The container liner is adapted to provide snug cuffing over the lip portion of the beverage container. In one embodiment a container liner is configured for heat shrink cuffing. In another embodiment a container liner is configured for stretch cuffing. A system for manual, mechanized and a combination of mechanized and manual installation of the removable conformal liner is disclosed.

4 Claims, 15 Drawing Sheets

(56) References Cited

U.S. PATENT DOCUMENTS

| | | | | |
|---|---|---|---|---|
| 2005/0115975 | A1* | 6/2005 | Smith et al. | 220/592.17 |
| 2010/0038361 | A1 | 2/2010 | Hwang | |

* cited by examiner

REPLACEABLE CONTAINER LINER, SYSTEMS AND METHODS

CROSS-REFERENCE TO RELATED APPLICATION(S)

The present non-provisional patent application claims the benefit of priority of U.S. Provisional Patent Application No. 61/427,476 which is entitled "REPLACEABLE CONTAINER LINER, SYSTEMS AND METHODS THEREOF", which was filed on Dec. 28, 2010, and which is incorporated in full by reference herein.

FIELD OF THE INVENTION

The technology described herein relates generally to the field of container liners. More specifically, the technology described herein relates to open top containers, e.g., beverage cups, ice cream cups, soup cups, oatmeal cups, yogurt cups, etc., that are further adapted to provide for a replaceable liner, and the systems for making and using the same.

BACKGROUND OF THE INVENTION

A cup is a general term for a vessel intended to contain beverages or liquid foods for drinking or consumption.

A paper cup is a cup made out of paper and often lined with plastic or wax to prevent liquid from leaking out or soaking through the paper. It may be made of recycled paper and is widely used around the world. Paper cups can be made from virgin paper; cups made from recycled content are limited to 10% recycled content by law.

Originally, paper cups for hot drinks were glued together and made waterproof by dropping a small amount of clay in the bottom of the cup, and then spinning at high speed so that clay would travel up the walls of the cup, making the paper water-resistant. However, this resulted in drinks smelling and tasting of cardboard.

Cups for cold drinks could not be treated in the same way, as condensation forms on the outside, then soaks into the board, making the cup unstable. To remedy this, cup manufacturers developed the technique of spraying both the inside and outside of the cup with wax. Both clay-coated and wax-coated cups disappeared with the invention of polyethylene (PE) coated cups; this process covers the surface of the board with a very thin layer of PE, not only waterproofing the board, but also allowing seams to be welded together. The waterproof PE lining makes it difficult to easily recycle paper coffee cups and renders cold drink cups unrecyclable. There are a few paper mills that will accept small quantities of hot drink cups for recycling.

Most paper cups are designed for a single use and then disposal or recycling. All cups have the following in common:

A bottom

Sidewall(s) attached to the bottom

An large opening at the top for filling and drinking sometime covered with a lid Made from a material that will hold liquid for the life of use Rigid enough to be picked up in one hand for carrying and consumption Rigid enough to have a lid pressed on Many cupped beverages are sold and consumed away from home and many beverages cupped at home are consumed away from home.

The advantage of selling and consuming beverages away from home and the inconvenience of returning or cleaning the cups after use has led to the widespread use of disposable cups. In order for these disposable cups to meet the minimum requirements they must both have significant strength for grasping and carrying and an inner surface that is impervious to the liquid and in the case of cold drinks an exterior surface impervious to accumulation of condensation during the life of use.

Since the cupped beverages sold away from home are generally inconvenient for the return of the cup, paper or plastic cups are generally used and disposed of after a single use. These cups require a considerable amount of material for strength and a liquid impervious surface that renders them very difficult to biodegrade, compost or recycle.

Also in the case of single use hot drink cups a method of protecting the hand from high temperatures is often a requirement. Cups filled at home and taken away must be brought back into a building in almost all cases for cleaning. Another problem with paper cups is that the seam on the side and lip of the cup creates an area where liquid can leak out when the lid is in place.

Over 6.5 million trees were cut down to make 16 billion paper cups used by US consumers in 2006, using 4 billion gallons of water and resulting in 253 million pounds of waste.

Very little recycled paper is used to make paper cups because of contamination concerns and regulations. Because most paper cups are coated with plastic, both composting and recycling of paper cups is uncommon.

Although paper cups are made from renewable resources (wood chips 95% by weight), paper products in a landfill may not decompose, or may release methane if decomposed anaerobically. The manufacture of paper usually requires inorganic chemicals and creates water effluents.

Paper cups may consume more non-renewable resources than cups made of polystyrene foam. A number of cities have banned XPS foam cups in take-out and fast food restaurants.

PE is a petroleum based coating on paper cups that can slow down the process of biodegrading. PLA is a biodegradable bio-plastic coating used on some paper cups. PLA is a renewable resource and makes paper cups more compostable, whereas PE is not renewable and is not compostable.

Traditionally paper cup and containers have a plastic liner adhered to the inside in order to make them waterproof. These liners cannot be easily separated from the paper at the end of the life of the container and the paper cup/containers are not designed to be washed, they are for single use only and therefore cannot be reused. Some efforts to recycle the hot-beverage paper container have been successful however this requires additional energy and significant fiber loss, also very few paper mills are equipped to handle this type of recycled material. Additionally the paper cup/containers with the plastic liners do not biodegrade completely and don not compost easily. Permanent cup/containers require washing between used that requires the use of hot water and soap.

The pervasiveness of coffee-to-go from coffee shops, fast food venues and restaurants has exacerbated the problem of recycling the portable single-use cups. An increasing number of environmentally conscious consumers are demanding that these establishments proactively tackle recycling and waste reduction. Initiatives to decrease the environmental impact of disposable cups include using a recycled-content cup sleeve instead of double-cupping; producing hot beverage cups with 10% post-consumer recycled fiber, and offering a discount to consumers to use their own reusable mugs or tumblers for their beverages.

In many communities, there is a dearth of commercial recycling facilities. Until this situation improves front-of-store recycling that is consumer friendly is needed. This effort will be a combination of new cup design, convenient collection, and recycling infrastructure. However developing recyclable cup solutions is vital.

A need exists to have a cup/container in which a plastic liner could be removed so that both the cup/container and liner can be recycled and the cup/container can biodegrade. In addition, a need exists with a permanent cup/container for the liner to be removed, thus eliminating the need to wash the cup/container.

Yet another need is to minimize manual assembly by having a machine to uniformly insert a liner into the cup/container and assist in the fitting of the liner snugly to the inside and outside of the cup/container. The liners need to be manufactured and configured to seamlessly feed into this machine and fit on the target cup, e.g. by a stretch-fit and/or shrink-fit process.

Related patents and published patent applications known in the background art include the following:

U.S. Pat. No. 3,373,917, issued to Cox on Mar. 19, 1968, discloses a foldable container;

U.S. Pat. No. 4,391,366, issued to Hirata on Jul. 5, 1983, discloses a foldable cup;

U.S. Pat. No. 6,458,067, issued to Dorin et al. on Oct. 1, 2002, discloses removable conformal liners for centrifuge containers;

U.S. Pat. No. 4,036,675, issued to Amberg et al. on Jul. 19, 1977, discloses film-lined foam plastic receptacles and laminated materials and methods for making the same;

U.S. Pat. No. 4,854,474, issued to Murray et al. on Aug. 8, 1989, discloses a composite drinking cup;

U.S. Pat. No. 6,889,455, issued to Giraud on May 10, 2005, discloses a method of incorporating a promotional item into a dual wall cup;

U.S. Pat. No. 7,513,386, issued to Hartjes et al. on Apr. 7, 2009, discloses a container employing an inner liner for thermal insulation;

U.S. Patent Application Publication No. 2010/0038361, filed by Hwang and published on Feb. 18, 2010, discloses a disposable cup which may be used as packing material and manufacturing method of the same; and International application WO 99/49770, filed by Miller et al. and published on Oct. 7, 1999 discloses a flushable potty liner.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an improved recyclable food container/beverage cup having a replaceable liner and methods and systems thereof for inserting the replaceable liner into a cup.

In one exemplary embodiment, the technology described herein provides a cup having a liner positioned inside the cup and extending to the outside lip area of the cup, where the liner provides a hygienic, liquid impervious surface that can be separated from the cup structure, allowing for recycling and the placement of a new liner within the cup.

In another exemplary embodiment, the technology described herein provides a device and a method associated with the device. With respect to the device, it is an open top container inner liner having a close fitting outside cuff portion, which allows the liner to be removed, allowing the cup to be recycled or relined. This liner can be used in permanent, disposable and collapsible cups. Elements of the technology described herein are a cup, a liner and a device to insert and secure the liner for releasable attachment.

In yet another exemplary embodiment the system is configured as follows: Liners can be provided in a bundle, stack or roll or may be created from a roll. Each liner is configured to press, stretch-on or shrink-fit both inside and outside of a container and to fit snugly by cuffing to the outside of the container. A provisioning device engages a liner, positions the liner into the corresponding container and folds the cuff of the liner over the outside of the container. In an exemplary embodiment utilizing a shrink system, e.g. using forced hot air, the cuff is shrunken to create the close fit. In this embodiment the target cup is below the provisioning device and the provisioning device moves in a substantially vertical movement down to install the liner and cuff it, then up to be positioned to engage the next liner. In other embodiments the cup and provisioning device may be in a horizontal orientation or at orientations between vertical and horizontal, e.g. at 45 degrees.

In one embodiment the process can be described as follows:

- Providing a cup in alignment with a liner insertion and attaching assembly;
- Acquiring a liner;
- Preparing the liner for cup insertion;
- Inserting the prepared liner into the cup;
- Attaching the liner to the cup; and
- Preparing the liner insertion and attaching assembly for acquiring a liner.

In one embodiment, the process can further be described as follows:

- Providing a cup in alignment with a liner insertion and attaching assembly;
- Acquiring a liner configured for insertion and attachment to the cup and containment of a beverage;
- Preparing the liner for cup insertion by preparing the top portion of the liner for opening and directing a burst of air from the liner insertion and attaching assembly into the prepared top portion of the liner;
- Inserting the opened liner into the cup using a correspondingly configured mandrel;
- Attaching the top portion of the liner to the top portion of the cup using a "fingered" device that presses the top portion of the liner against the top portion of the cup and directs heat toward the top portion of the liner to seal the liner just below the top perimeter of the cup; and
- Preparing the liner insertion and attaching assembly for acquiring a liner by retracting the mandrel and fingered portion of the assembly.

In yet another exemplary embodiment the method of using the technology described herein involves the following:

- The cup liners are flat and are in a stack/pad and they are hanging from a wicket;

Above the liners is a mandrel the bottom part of which has substantially the same shape and size as the inside of the target cup;

The upper part of the mandrel has articulating fingers that when deployed can move down past the outside of the lower part of the mandrel;

The fingers are first in their raised retracted position;

Once the cup is placed in the proper position below the liners and mandrel either manually or mechanically the liner machine can be operated;

The first action of the machine is to close a safety door or activate a safety system designed to prevent the user's hands or other objects from being in the machine while it is being operated;

With the cup in place the first action is for the machine to open the liner;

This is done by blowing air into the top of the liner and in some cases with the assistance of a vacuum cup that will attach to the free side of the liner and pull it open;

Since one side of the liners is captured by the wicket then as the liner is opened it will be in position to receive the mandrel;

When the liner is open then the mandrel descends into the liner;

A small amount of air can be directed though the bottom of the mandrel to help keep the liner inflated as the mandrel descends;

Once the mandrel has reached the effective full depth of the liner then the force of the mandrel will shear the liner off the wicket;

During the shearing the air being forced through the mandrel may be reversed to pull the liner against the mandrel;

As the liner is being sheared it is also descending into the cup and the mandrel will continue downward until it bottoms out in the bottom of the cup;

The system is currently designed for only one internal cup size and shape per mandrel;

A machine may have multiple mandrels and liner wickets, but each mandrel is for a specific internal cup size and shape the external size and shape can vary with in specific limits;

Once the mandrel bottoms out in the cup the mandrel can no longer move but the top part of mandrel is compressible;

The compression of the upper part of the mandrel will first cause the fingers to move outward causing the liner cuff to be fully expanded beyond the rim of the cup;

After the fingers are fully expanded they will continue to be pushed downward forcing the liner cuff to the outside of the cup;

Once the entire liner cuff has peeled off the fingers then the cuffing fingers will be pulled back up;

When they reach the upper limit they will retract and the mandrel will be fully in the cup with the liner cuff on the outside of the cup;

At this stage the mandrel will remain stationary and the cuff heat shrinking units (HSU) will move into position about ⅛" away from the cup rim;

The cuff HSU may be turned on slightly before they start moving so that they are at optimal temperature by the time they are in place;

The heat from the cuff HSU will cause the liner cuff to shrink around the outside of the cup;

The may be conducted, infrared or convection or a combination any or all;

When the heating cycle is complete the cuff HSU will retract and the mandrel will retract;

The two actions may be simultaneous or one action might happen slightly before the other; and Once the mandrel and cuff HSU are safely out of the way the cup can be removed and is ready for filling with the appropriate beverage.

In yet another exemplary embodiment the method utilizes a stretch liner, i.e., the top of the liner stretches over the lip of the cup to create a close fitting cuff, instead of a shrink liner and comprises:

The liner is shaped to fit against the inside walls of the cup or slightly away from the inside walls if it is desired to create a gap for insulation;

Flat Liner;

The liner is opened;

A plunger goes into the liner and pushes it down into the cup;

The plunger expands to press the liner against or near to the inside wall of the cup;

Fingers stretch the top of the liner outward slightly larger than the lip of the cup;

The Fingers descend rolling the cuff to the outside of the cup; and

The Fingers and plunger retract upward and the cup is ready for use.

One advantage of the technology described herein is that it eliminates the need for washing the cup.

Another advantage of the technology described herein is that it allows for the multiple reuse of the cup structure.

Another advantage of the technology described herein is that it allows the cup structure to be recycled.

Another advantage of the technology described herein is that it allows the cup structure to biodegrade.

Another advantage of the technology described herein is that it allows the cup structure to be compostable.

Another advantage of the technology described herein is that it ensure hygiene.

Another advantage of the technology described herein is that it allow for the use of 100% post-consumer (PC) waste in the cup structure.

Another advantage of the technology described herein is that it captures unconsumed beverage for processing.

Another advantage of the technology described herein is that it allows for the recycling of the liner.

Another advantage of the technology described herein is that it reduces the consumption of a natural resource.

Another advantage of the technology described herein is that the liner works as a gasket to prevent leakage at the seam with the lid in place.

Another advantage of the technology described herein is that an air gap can be created between the liner and the container inside structure to create insulation to protect the hand and maintain the beverage temperature.

Another advantage of the technology described herein is that once the liner has been inserted the cups can be stacked by inserting one liner-filled cup into another liner-filled cup, thus minimizing the footprint of multiple cups.

Traditionally, drinking from a cup with a plastic liner is quite unpleasant because the plastic is drawn into the mouth when sipping or the plastic sticks to the consumer's lips. The technology described herein eliminates this problem because it is held close enough to the outside wall of the cup so that during the drinking process neither is the liner pulled into the mouth nor does the liner stick to the consumer's lips. In addition, the close cuff is not bunched as might occurs when a liner is held with an elastic band or draw string, but is substantially smooth around the outside edge of the cup allowing for more comfort to the lips, plus it does not contribute to dribbles.

Structurally the liner and receptacle are separate, yet they fit very close together until it is desired to separate them and then they separate easily. When liners need to be fit closely to the inside of the receptacle they are generally adhered to the inside making them extremely difficult to separate from the paper which make the receptacle difficult to recycle or biodegrade. The technology described herein has the paper of the cup and the plastic of the liner as separate components, thus facilitating recycling and biodegrading, plus the liner can be used with a permanent cup eliminating the need for washing between every use.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
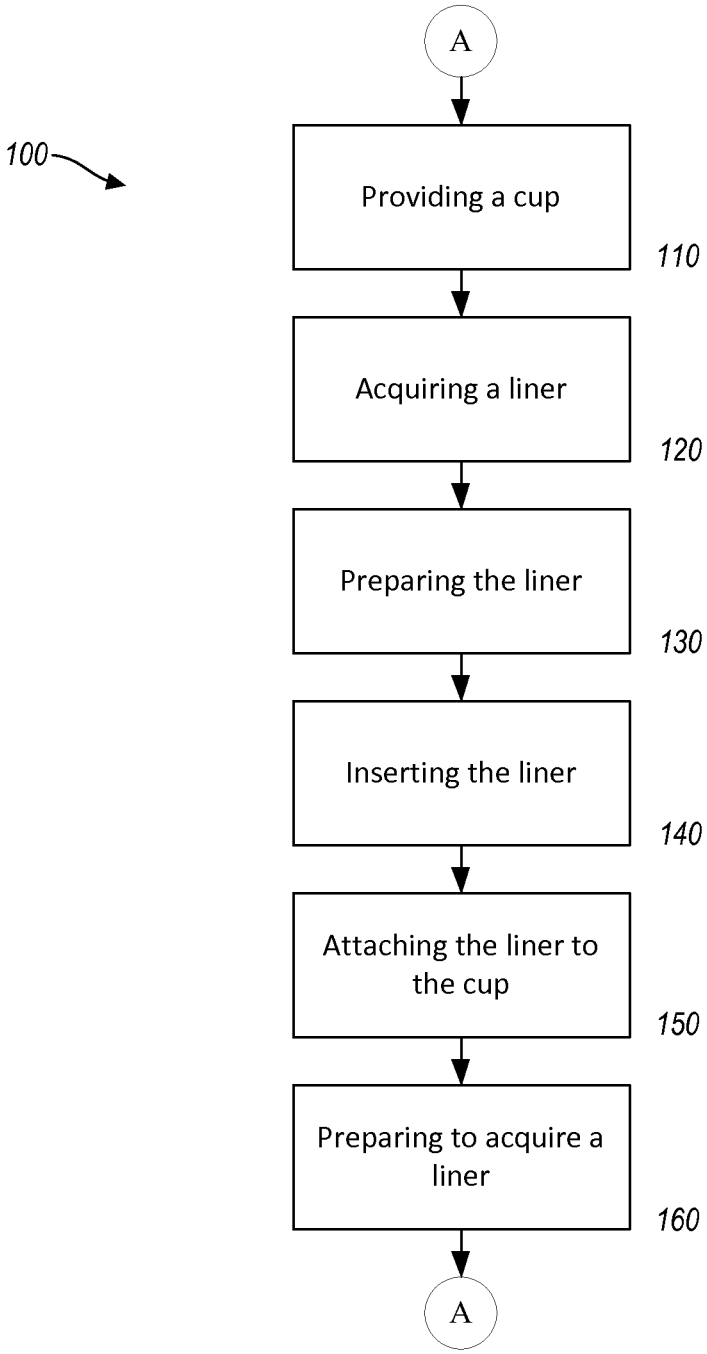
FIG. 1 is a illustrates a sequence in which a cup has an liner inserted and attached utilizing a insert and attachment assembly, according to an embodiment of the technology described herein.
Figure 2:
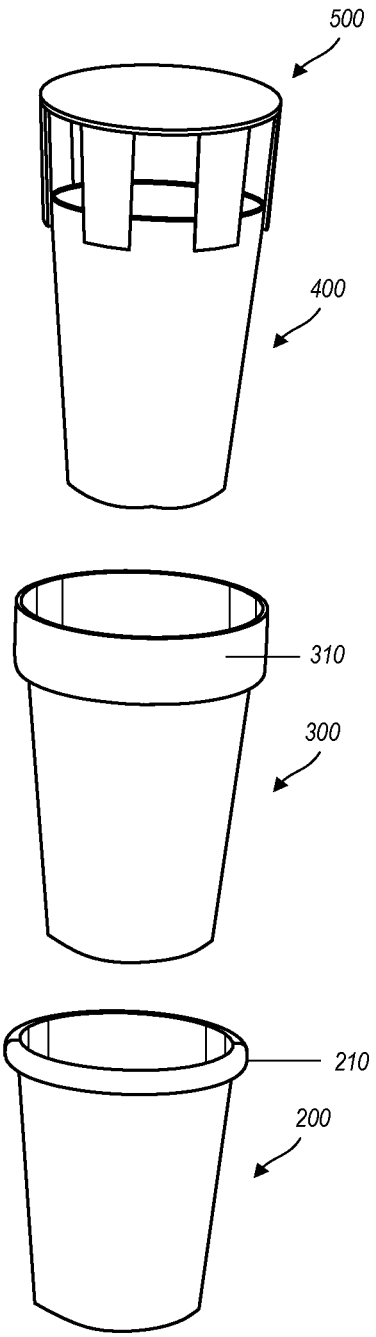
FIG. 2 illustrates a beginning arrangement of a cup, liner, mandrel and Fingers for a shrink fit process, according to an embodiment of the technology described herein.
Figure 3:
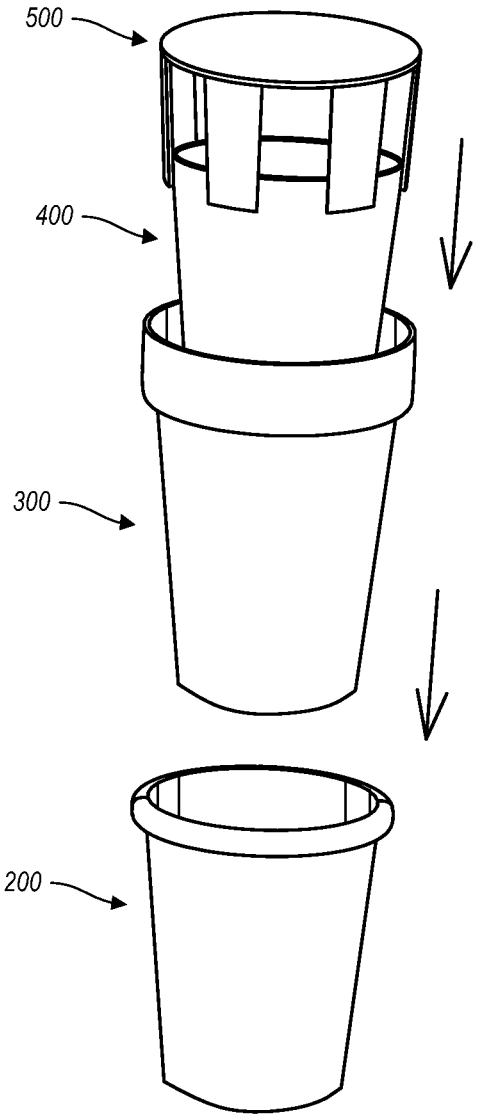
FIG. 3 illustrates a subsequent arrangement of FIG. 2 where the mandrel is inserted into the liner.
Figure 4:
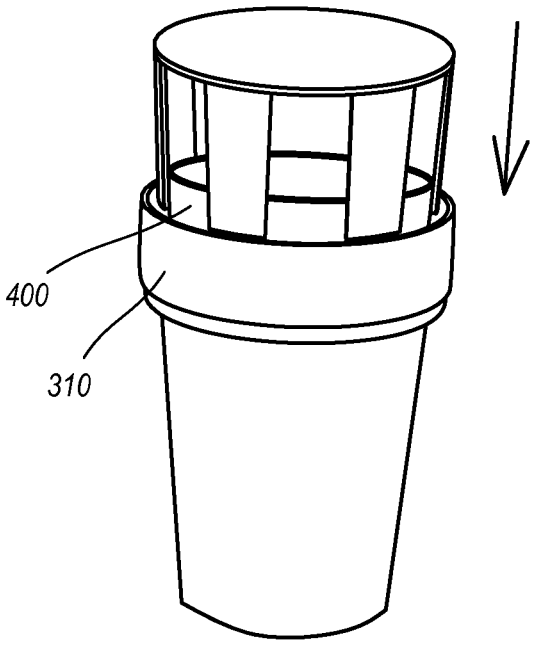
FIG. 4 illustrates a subsequent arrangement of FIG. 3, where the mandrel has almost completed inserting the liner into the cup with a portion of the top portion of the liner now being positioned over the outside of the cup top.
Figure 5:
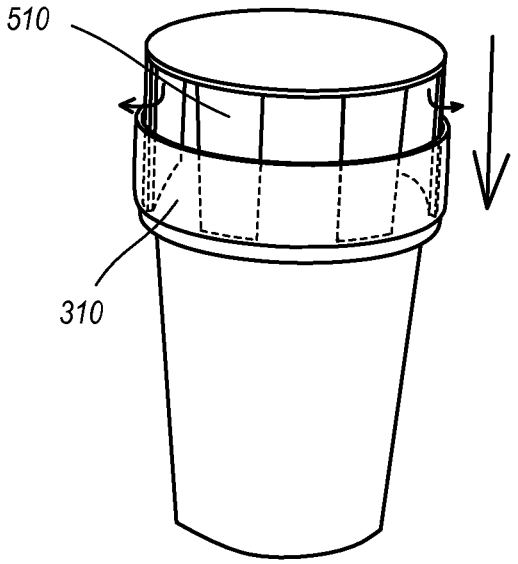
FIG. 5 illustrates a subsequent arrangement of FIG. 4, where the Fingers are engaging the inside of the top portion of the liner in order to closely position the top portion of the liner against the top of the cup prior to heat sealing.
Figure 6:
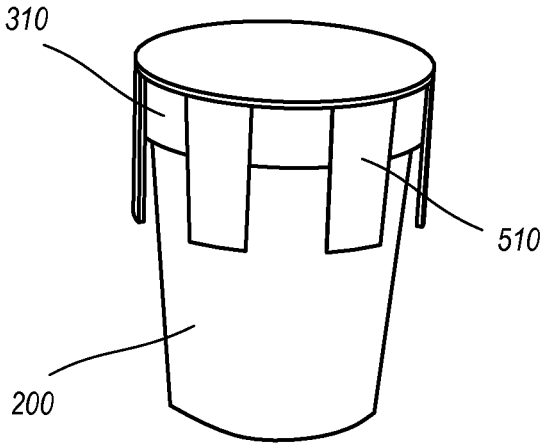
FIG. 6 illustrates a subsequent arrangement of FIG. 5, where the Fingers are now on the outside of the cup and the top portion of the liner is closely positioned against the top of the cup prior to heat sealing.
Figure 7:
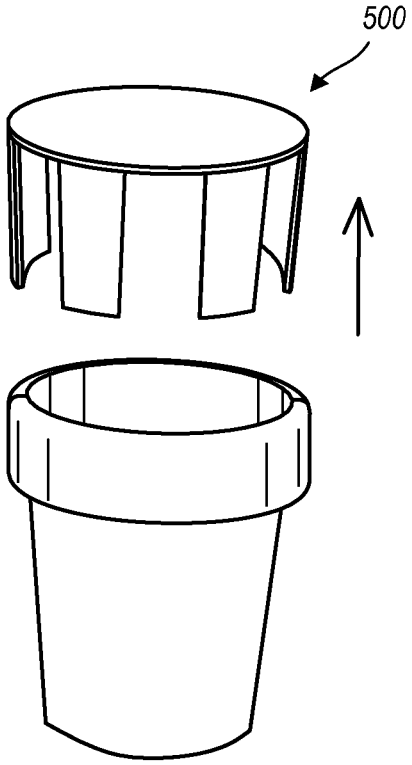
FIG. 7 illustrates the removal of the Fingers shown in FIG. 6.
Figure 8:
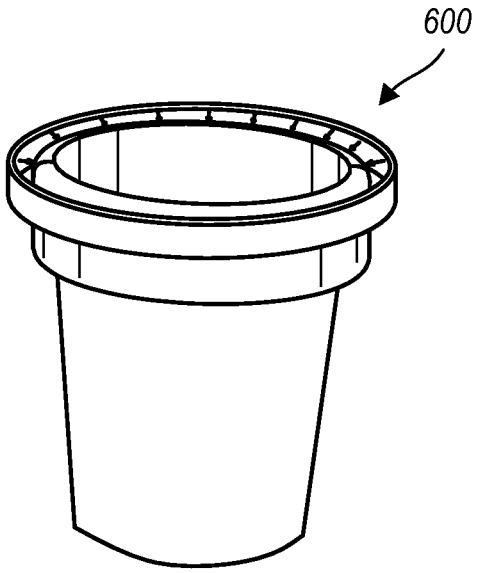
FIG. 8 illustrates a heat sealing assembly sealing the liner to the cup lip.
Figure 9:
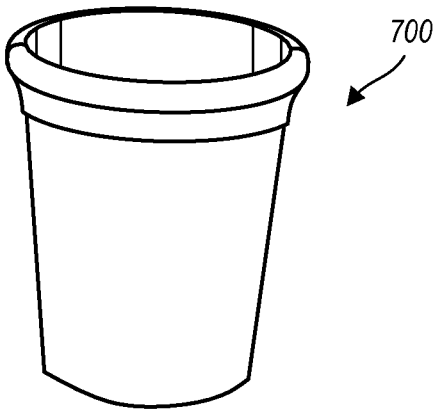
FIG. 9 illustrates a cup having a heat sealed liner.
Figure 10:
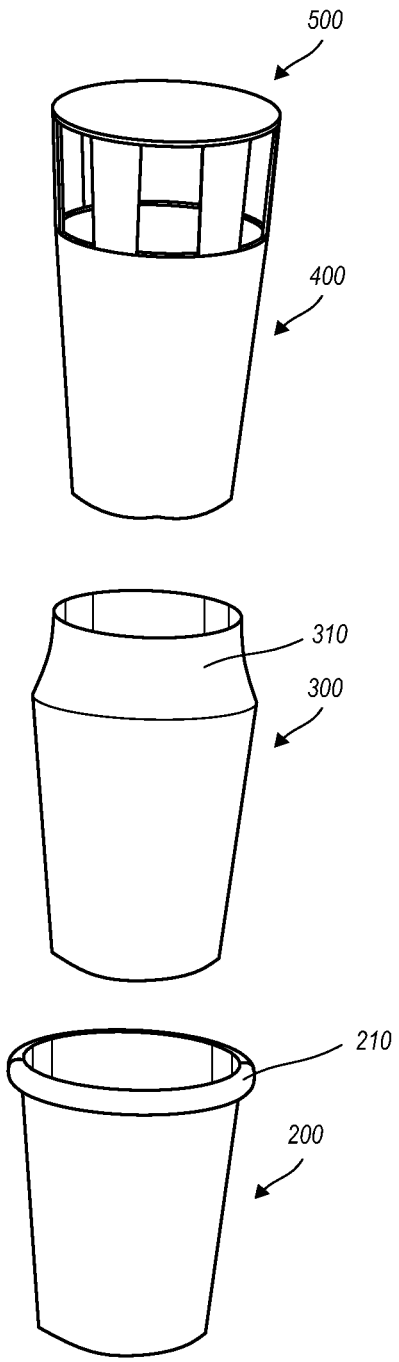
FIG. 10 illustrates a beginning arrangement of a cup, liner, mandrel and Fingers for a stretch fit process, according to an embodiment of the technology described herein.
Figure 11:
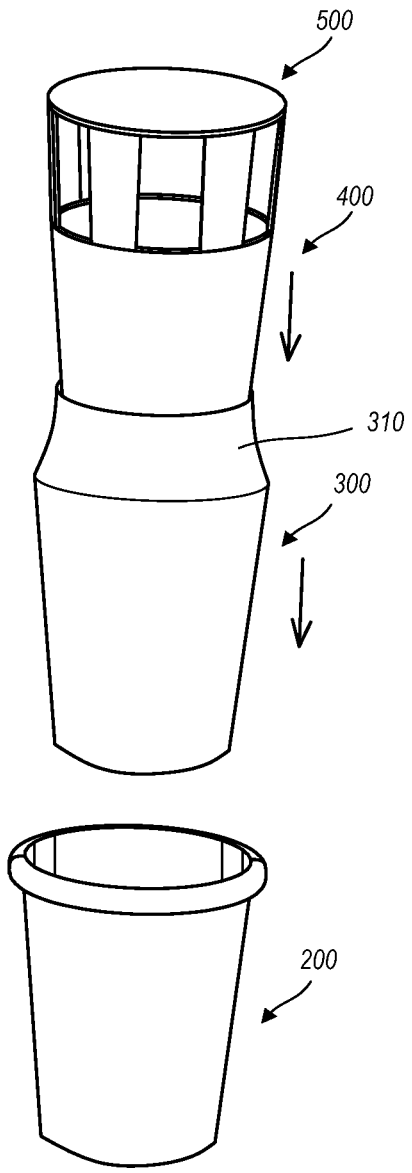
FIG. 11 illustrates a subsequent arrangement of FIG. 10, where the mandrel is partially inserted into the liner.
Figure 12:
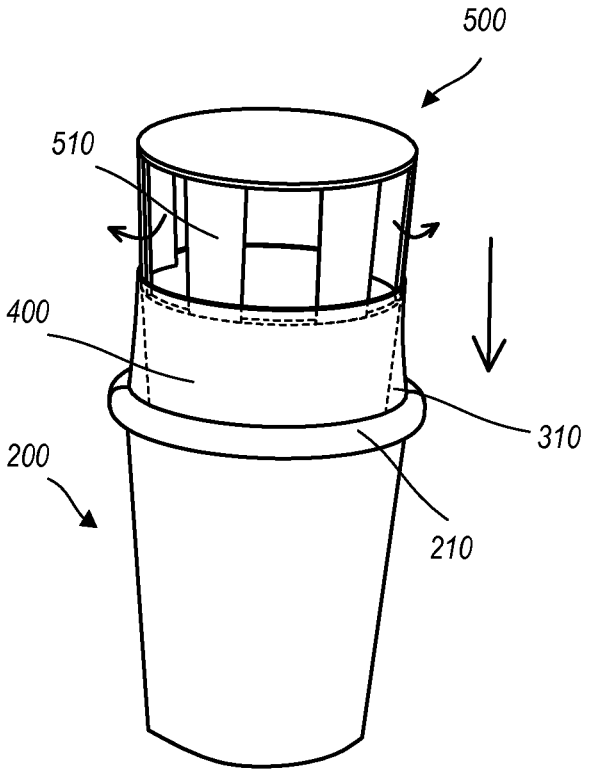
FIG. 12 illustrates a subsequent arrangement of FIG. 11, where the mandrel and liner are partially inserted into the cup.
Figure 13:
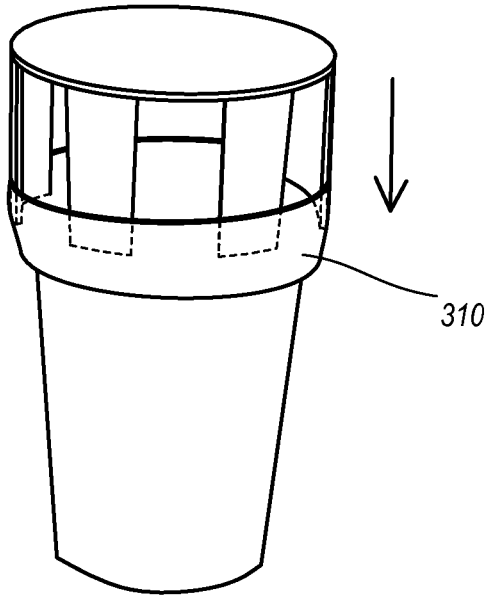
FIG. 13 illustrates a subsequent arrangement of FIG. 12, where the liner is inserted into the cup and the Fingers are starting the process of stretching the top portion of the liner over the cup lip.
Figure 14:
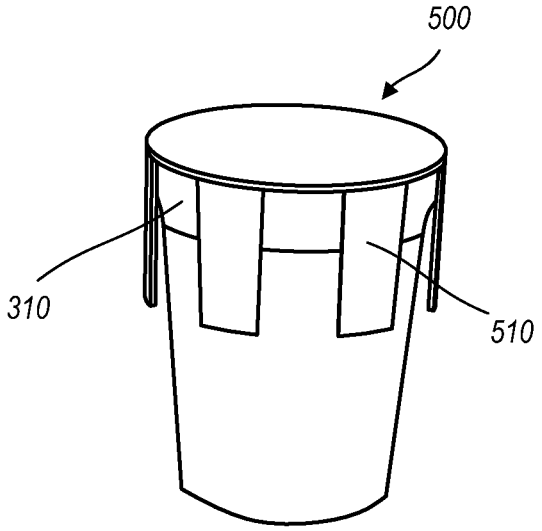
FIG. 14 illustrates a subsequent arrangement of FIG. 13, where the Fingers are on the outside of the cup and top portion of the liner, having stretch fitted the liner over the cup lip.
Figure 15:
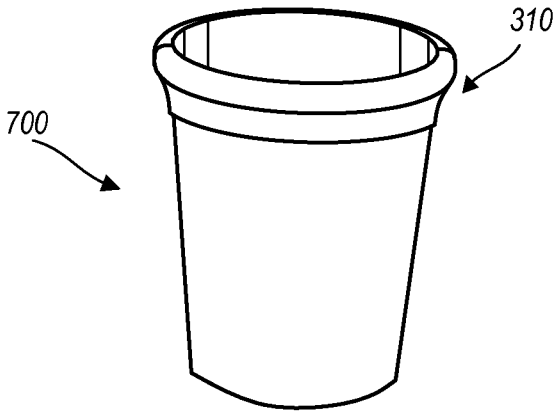
FIG. 15 illustrates a cup having a stretch fitted liner.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a cup/container liner system, comprising an open top cup/container and a liner that fits closely on the outside. These components are related as follows: the liner is inserted into the cup/container and is cuffed over the outside of the cup/container in a close fitting manner. The liner may or may not fit closely on the inside.

In the cuffing process the liner can be stretched or shrunk to fit snuggly on the exterior of the cup/container. This stretching/shrinking can be done manually, mechanized or a combination of manual and mechanized.

In at least one embodiment the liner creates a gasket over the seam of the container. The liner is configured for displaying recycling and/or disposal information. The cup/container can be made from either disposable or non-disposable material.

The cup/container may be made from 100% recycled and post-consumer recycled material. The cup/container may or may not be leak proof. The liner is configured for the capture and control of unconsumed contents.

The liner can eliminate the need to wash the cup/container prior to reuse. The liner may be formed in a variety of configurations. The liner may be clear or any degree of opacity. The liner may be inserted, cuffed and close-fit either by hand, device or automated/semi-automated machine.

In at least one embodiment, e.g., the "Cup" version, the technology described herein comprises a paper/permanent cup with a liner that fits snugly to the inside of the cup so that the liner does not bear any of the load of the content. The liner folds over the rim of the cup and fits snugly to the outside of the cup so the lips of the drinker contacts the liner. The liner fits in such a way that it does not interfere with the lidding and un-lidding of the cup and helps provide a seal in the area between the lid and the seam of the cup. The liner is in close communication with the cup, yet capable of being released.

In yet another embodiment, e.g. the "Container" version, the technology described herein is comprised of a paper/permanent container with a liner that fits to the inside of the container so that the liner folds over the rim of the cup and fits closely to the outside of the cup is such a way that the cuff of the liner remains primarily in contact with the outside of the container, which contributes to a neat appearance and assists in the application and removal of a lid. Rolling the liner to the outside also provide an area at the top of the rim configured to bond a lid seal.

Referring now to FIGS. 1-15, in various exemplary embodiments, the technology described herein provides a system and device for combining a container liner with a container such that the container liner remains in place during the consumption of the liquid contents placed within, and subsequently the container liner can be detached from the container.

FIG. 1 shows an illustrative sequence for inserting and fitting a liner into a cup prior to filling of the cup with a beverage. A cup is provided in providing a cup 110. The cup can be positioned so as to receive the liner either manually, or by a mechanized delivery system. Acquiring a liner 120 can involve either a manual acquiring or by a mechanized acquiring system. Preparing the liner 130 can involve either a manual opening or a mechanized sequence of partially opening the liner and then have a mechanized puff of air completing the liner opening process. Inserting the liner 140 can involve a mandrel being inserted into the opened liner and the mandrel enshrouded with a liner being inserted into the cup. Attaching the liner to the cup 150 involves the Fingers 500 positioning the liner top portion 310 either being heat shrunk or stretch fitted over the cup lip 210. Preparing to acquire a liner involves the liner and attachment assembly retracting back to the starting position.

FIGS. 2-9 show one scenario for creating a heat shrink seal for an inserted cup liner. A cup 200 having a cup lip 210 has a liner 300 with a liner top portion 310 configured for overlapping the cup lip 210 is shown. A mandrel 400 is dimensioned to be placed inside the liner 300 during the process of inserting the line 300 into the cup 200. Fingers 500 having individual fingers 510 are configured for positioning the liner top portion 310 over the cup lip 210. Heat assembly 600 is utilized to attach the liner top portion 310 to the cup lip 210 and a portion of the outside of the cup 200 to form a shrink fitted cup-liner assembly 600. In some embodiments, the heat assembly function is integrated into the Fingers 500.

FIGS. 10-15 show one scenario for creating a stretch fit seal for an inserted cup liner. The liner 300 has a concave opening (as opposed to a convex opening for the heat shrink seal liner) configured for being stretched over the cup lip 210 by the individual fingers 510 to form a stretch fitted cup-liner assembly 700.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology described herein and are intended to be covered by the following claims.

What is claimed is:

1. A method for providing an improved recyclable beverage cup, the method comprising:

providing a cup in alignment with a means for liner insertion and attachment;

acquiring a liner;

preparing the liner for cup insertion;

inserting the prepared liner into the cup using a correspondingly dimensioned mandrel having an upper part having a plurality of articulating fingers greater than two and defined extended downwardly in a circular pattern from a circular base and expandable from the mandrel that start in a raised retracted position and that when deployed are movable down past an outside of a bottom part of the mandrel which has substantially a same shape and size as an inside of a target cup; and attaching the liner to the cup.

2. The method of claim 1, further comprising:

preparing the means for liner insertion and attachment for acquiring a liner.

3. A method for providing an improved recyclable beverage cup, the method comprising:

providing a cup vertically in alignment with a means for liner insertion and attachment;

acquiring a liner configured for insertion and attachment to the cup and configured for containment of a beverage, the liner having a top portion configured for opening and attaching to the cup;

preparing the liner for cup insertion by partially opening the top portion of the liner;

directing a burst of air from the means for liner insertion and attachment into the partially opened top portion of the liner to create an opened liner;

inserting the opened liner into the cup using a correspondingly dimensioned mandrel having an upper part having a plurality of articulating fingers greater than two and defined extended downwardly in a circular pattern from a circular base and expandable from the mandrel that start in a raised retracted position and that when deployed are movable down past an outside of a bottom part of the mandrel which has substantially a same shape and size as an inside of a target cup;

attaching the top portion of the liner to the top portion of the cup using a device that presses the top portion of the liner against the top portion of the cup and directs heated air from a heat assembly separate from the mandrel, toward the top portion of the liner to seal the liner in the proximity of the top outside perimeter of the cup;

shrinking the insert; and preparing the means for liner insertion and attachment for acquiring a liner by retracting the mandrel and fingered portion of the assembly.

4. A method for providing an improved recyclable beverage cup, the method comprising:

providing a vertically cup in alignment with a means for liner insertion and attachment;

acquiring a liner configured for insertion and attachment to the cup and configured for containment of a beverage, the liner having a top portion configured for opening and attaching to the cup;

preparing the liner for cup insertion by partially opening the top portion of the liner;

directing a burst of air from the means for liner insertion and attachment into the partially opened top portion of the liner to create an opened liner;

inserting the opened liner into the cup using a correspondingly dimensioned mandrel having an upper part having a plurality of articulating fingers greater than two and defined extended downwardly in a circular pattern from a circular base and expandable from the mandrel that start in a raised retracted position and that when deployed are movable down past an outside of a bottom part of the mandrel which has substantially a same shape and size as an inside of a target cup;

attaching the top portion of the liner to the top portion of the cup by stretching the top portion of the liner over the top portion of the cup to form a stretch fitted seal on the cup lip; and preparing the means for liner insertion and attachment for acquiring a liner by retracting the mandrel and fingered portion of the assembly.

* * * * *